United States Patent [19]

Ross

[11] 4,105,725

[45] Aug. 8, 1978

[54] SATURATED LIQUID/VAPOR GENERATING AND DISPENSING

[75] Inventor: Edward Alan Ross, Willowdale, Canada

[73] Assignee: Liquid Carbonic Canada Ltd., Montreal, Canada

[21] Appl. No.: 392,080

[22] Filed: Aug. 27, 1973

[30] Foreign Application Priority Data

Nov. 21, 1972 [GB] United Kingdom ..... 53767/72
Jun. 29, 1973 [CA] Canada ..... 175275

[51] Int. Cl.[2] ..... B01F 3/04

[52] U.S. Cl. ..... 261/122; 164/16; 261/64 B; 261/DIG. 7; 261/DIG. 65; 285/158; 285/286; 285/405

[58] Field of Search ..... 261/122, DIG. 7, DIG. 65, 261/64 B; 164/5, 12, 16, 43; 48/107, 180 R; 285/158, 286, 405; 222/3

[56] References Cited

U.S. PATENT DOCUMENTS

| | | | |
|---|---|---|---|
| 2,584,450 | 2/1952 | Holt et al. | 261/122 X |
| 3,215,140 | 11/1965 | Caparrelli | 261/122 X |
| 3,256,802 | 6/1966 | Karr | 261/122 X |
| 3,316,166 | 4/1967 | Bergson et al. | 261/122 X |
| 3,362,697 | 1/1968 | Silva et al. | 261/122 X |
| 3,545,731 | 12/1970 | McManus | 261/122 |
| 3,578,295 | 5/1971 | Hudson | 261/DIG. 7 |
| 3,590,902 | 7/1971 | Walker et al. | 164/16 X |
| 3,604,729 | 9/1971 | Braucksiek et al. | 285/158 X |
| 3,756,577 | 9/1973 | Breiling | 261/DIG. 65 |

*Primary Examiner*—Richard L. Chiesa
*Attorney, Agent, or Firm*—Charles E. Brown

[57] ABSTRACT

A process for generating in a pressure vessel a ready supply of a vapor of a normally liquid active substance in an inert carrier gas under pressure and dispensing vapor intermittently from the supply. Once a body of the active liquid substance and overlying atmosphere of vapor is established in the vessel, the vapor is dispensed intermittently in a series of predetermined doses. Simultaneously with the dispensing of each dose, carrier gas is bubbled under pressure into a bottom zone of the vessel in minute bubbles so as to provide saturated vapor, replacing the dose dispensed. A number of conditions are coordinated to insure that saturated vapor is always dispensed. These conditions include the relationship between the depth of the vapor space, the head of liquid above the bubbling zone, the relative amount of each dose, and the initial size of the bubbles. The process is specially useful for gassing cold box cores.

The apparatus includes a subdividing unit which is desirably a sintered stainless steel cylinder through which the gas is introduced into the liquid.

22 Claims, 4 Drawing Figures

FIG. 1
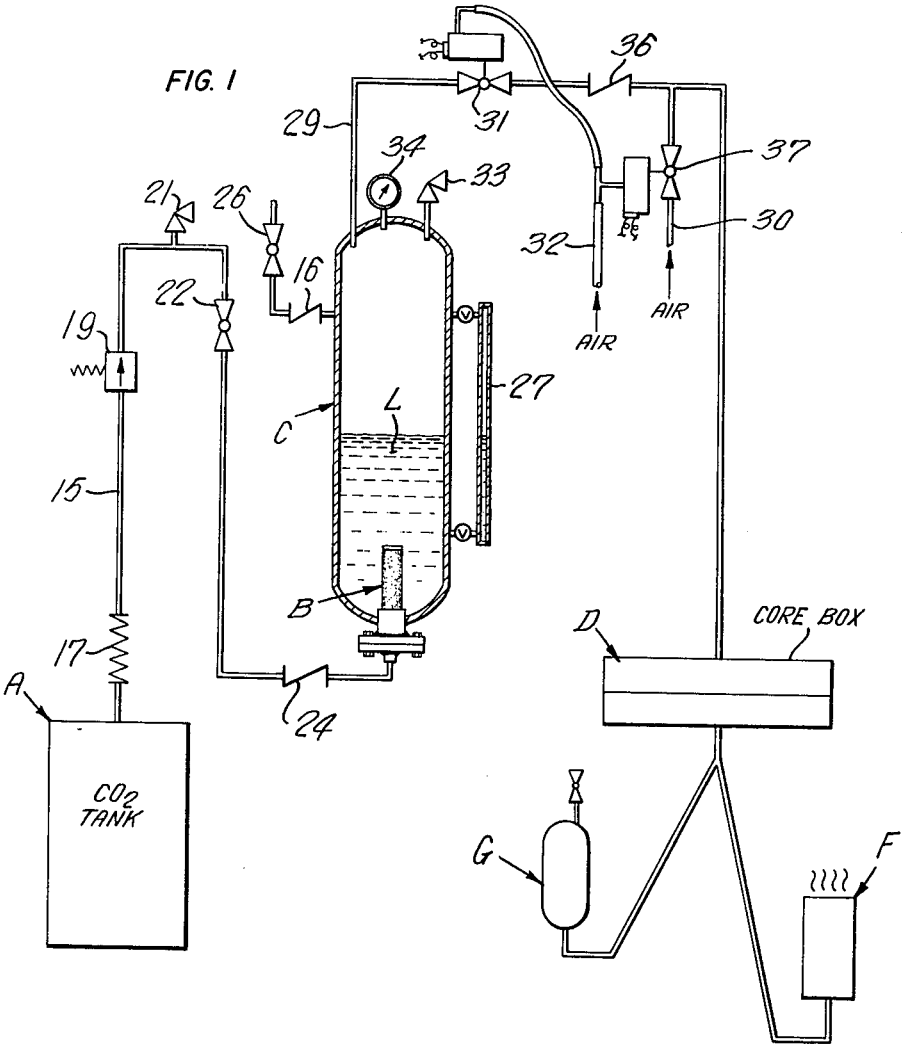
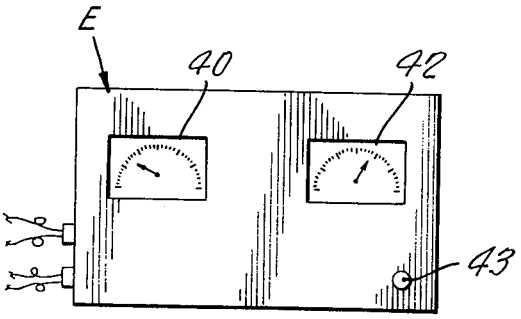
FIG. 2

SATURATED LIQUID/VAPOR GENERATING AND DISPENSING

BACKGROUND OF THE INVENTION

1. Field of the Invention

This invention relates to a method and apparatus for generating and intermittently dispensing a saturated vapor of an active liquid in an inert carrier gas under pressure.

The invention is specially applicable to gassing said cores used in metal casting and will be described in this context by way of illustration.

2. Description of the Prior Art

In making sand cores, by the "cold box" method, a foundry mix is first prepared by mixing with sand a combination of binder substances, for example an isocyanate and a phenolic resin. The foundry mix is deposited in a sand hopper above the coring machine. Increments of sand are packed, on demand, into the core box cavity to mold a green core supported by the walls of the core box. A vapor containing an amine curing agent is passed through the core to cure the binder to form a self-supporting body. Air is finally passed through the core to purge it of excess amine vapor.

Several methods have been used to pass the curing vapor into the sand core. In some of these, the amine is entrained in an air stream, using metering pumps, oil lubricators, syphon arrangements or spray nozzles. The amine must be vaporized and diffused through the air stream while it is in motion. In this system, the gassing times tend to be lengthened because of poor or uneven diffusion. Also, non-vaporized liquid amine may remain in the air stream and be deposited in the sand and, as the hot metal is later poured, outgassing will occur, i.e. gas will be evolved from the amine liquid and cause porous castings. Further, since the amine is usually introduced into the air stream a few feet from the core box, it is impossible, in the limited time period (less than one second), to attain close to satisfactory concentration of amine. Should an attempt be made to add more amine, in this short interval, the added amine will not have time to vaporize and some of it will be deposited (as a liquid) in the sand core with resultant outgassing. Precautions must also be taken because of the flammability of the amine-air mixture. In addition, because of the short space of time between the introduction of the liquid amine to the air stream, and its entering the sand core, these methods can only handle relatively small cores.

A further expedient has been to use a prefilled syphon-type cylinder filled with high pressure (say 750 psig at 70° F.) mixture of liquid amine and liquid carbon dioxide. A valve on this cylinder is fitted with a syphon tube which goes to within a short distance from the bottom of the cylinder. The vapor pressure above the liquid in this case forces the mixture of liquid amine and liquid $CO_2$ up through the syphon tube through a vaporizer and then through a pressure reducing regulator. Since a proportion of the amine tends to recondense it has been usual to pass the mixture through a second vaporizer and then to the core. This procedure has limitations. Due to the corrosive nature of amine, the only available regulators are corrosive service stainless steel regulators. These regulators are basically designed for very low volume dispensation, thus placing a limited capacity on both core size and high speed cycling.

Attempts to obtain an amine-rich vapor by bubbling air or gas through a perforated pipe or screen immersed in liquid amine creates bubbles too large to effectively pick up enough amine to sustain high speed coring. Also, the agitation of large bubbles allows droplets of liquid amine to be entrained with the air or gas stream, again resulting in porous castings.

SUMMARY OF THE INVENTION

The applicant has developed a process which overcomes the disadvantages mentioned and provides certain positive advantages, which will be apparent from the following description. The process of the invention provides for the generating and intermittent dispensing of a continuous supply of a vapor of an inert carrier gas saturated with a liquid active agent, for example an amine curing agent for sand cores. According to a preferred aspect of the invention, a closed dispensing saturator vessel is first partially filled with a body of the liquid agent. Then the carrier gas, under pressure, is subdivided and introduced in minute bubbles into a bottom zone of the body of liquid agent to provide, above the surface of the liquid, an atmosphere of liquid carrier gas saturated with the agent. The vapor is intermittently dispensed from the vessel and simultaneously replenished by introducing more carrier gas under pressure in minute bubbles into the bottom zone of the body of liquid. The invention makes it possible, as will be descirbed later in more detail, through control of a number of variables, to provide and maintain a saturated vapor having a high concentration of active liquid agent in the vapor phase and substantially free of liquid droplets, under conditins of continuous intermittent dispensing of doses of the vapor to a receiving unit.

When the process is used for gassing cores with an amine curing vapor (the receiving unit being the core box and connecting piping), on each gassing cycle, curing vapor is passed rapidly from the pressure vessel to the inlet of the core box under a pressure and for a time effective for the curing vapor to reach all parts of the core so that the binder is cured throughout. Simultaneously, more carrier gas is bubbled through the liquid amine to replenish, instantaneously, the curing vapor bled off. Then, immediately the passage of curing vapor to the core box is cut off and air under pressure is passed to the core box for a time effective to purge the shaped product of non-reacted curing vapor. The invention makes it possible to provide a homogeneous mix of the amine and the inert gas so as to give the right dosage concentration for good cores.

The arrangement of the apparatus must be such as to insure that the vapor reaches all parts of the core. In some cases, as will be understood in the cold box art, it may be necessary for the core box to have a number of gas inlet ports and vent exit ports to effect equal and total distribution of the curing vapor. The invention provides for high speed gassing, where it is essential to have available, at all times, a pregenerated supply of amine-saturated inert gas vapor which will completely and uniformly displace the air trapped between the sand grains and core box and, on its passage through the sand, reach the binder on each grain to effect uniform cure.

The variables, referred to above, whose control is required for maximum quantity and degree of saturation of the vapor with the active substance, under prevailing conditions of dispensing, the applicant has found, include the ambient temperature surrounding the vessel in which the gas is generated, the temperature of the incoming carrier gas and consequently the temperature of the liquid in the vessel, the degree of intimacy of contact of the inert gas with the active liquid, and the time of intercontact. These variables are interrelated to the nature of the equipment, for example, the size shape and position of the vessel and hence the size of the respective liquid and vapor spaces, the extent to which the vessel is filled with liquid and the quantity of active vapor withdrawn per cycle, and the relative volumes of the vapor space of the dispensing vessel and of the receiving unit for the size of each dose dispensed. These factors are correlated, according to the invention, to provide, on each dispensing cycle, a minimum pressure drop necessary to maintain the velocity, as it passes through the liquid and vapor spaces, of the replenishing inert gas supply required for the degree of saturation required. The velocity of the gas passing through the liquid must be sufficiently low to allow any liquid particles leaving the liquid space time enough to drop back to the liquid and not be carried through the vapor space and through the exit lines. The criticality of certain of the control factors will also vary with the particular liquid active agent employed.

From a practical standpoint, the saturator-generator vessel should be elongated in the up and down direction and have a height of at least about five times its mean width, to insure enough depth for adequate liquid and vapor spaces. The saturator-generator vessel also acts as a vaporizer, so an extensive surface area is needed to extract the heat from the surrounding atmosphere and to transmit this to the liquid in the vessel. The vapor space of the dispensing saturator vessel must have a volume at least three times, preferably at least four times, that of each dose, i.e. of the volume of the receiving unit (in the case of gassing cores, the volume of the receiving unit would be that of the core box cavity and connecting pipes). This sizing is to maintain the minimum pressure drop needed to provide and conserve the conditions previously discussed. The actual size and shape of the vessel may vary, but a typical vessel, for cold box gassing, is a cylinder having a height of about 6 feet and a diameter about 14 inches. For economy and corrosion resistance, the vessel is best made of a corrosion resistant material, preferably steel. Copper and aluminum are to be avoided. The wall thickness of a steel vessel may be approximately a quarter of an inch, but this is not critical.

The dispensing saturator vessel should not be filled with liquid to more than one-half its height, preferably not more than one-third of its height, to insure that the vapor space is sufficiently long that, under conditions of dispensing the vapor in cycles, any entrained liquid droplets that may leave the liquid surface have sufficient travel time, before they reach the vapor outlet, to drop back into the liquid, rather than being carried into the dispensing line. This ensures that only saturated vapor without liquid droplets is dispensed. There should be a head of liquid of not less than about 8 inches, preferably not less than about 10 inches above the zone of introduction of the bubbles so that the bubbles have enough travel time between their entry into the liquid and before they reach the surface to insure the intimate contact between gas and liquid needed for reliable saturation and to avoid liquid droplets being propelled into the vapor space.

In providing a vapor of a liquid amine curing agent, having a low vapor pressure, for example, trimethylamine (T.E.A.) the vapor will, at best, contain a lower proportion of the substance, so that total saturation is most important to insure a high enough concentration of amine in the vapor. This being the case, the ambient temperature surrounding the vessel should be kept within the range from about 65° to about 75° F., with the incoming gas the same or preferably slightly less, for example 5° to 10° F. lower, and the temperature of the amine within the vessel preferably at not less than 5° F. below the ambient temperature surrounding the vessel, ideally in the neighbourhood of 2° or 3° F. below the ambient temperature.

It is also important, the applicant has found, that, to attain complete saturation with either trimethylamine or dimethylamine, the inert gas be introduced into the liquid amine in the form of minute bubbles small enough to provide substantial gas-liquid contact, for example having an initial size within the range from about 5 to about 25 microns, with a range from about 8 to about 18 microns preferred. This may be accomplished by introducing the carrier gas into the amine liquid through a porous subdividing element.

A preferred subdividing unit includes an element of sintered stainless steel of the type normally used for filtering. Preferably, the element is a cylinder having a wall of outside diameter from about one inch to about 2½ inches and of a length between about 5 inches and ten inches with a thickness within the range from about one thirty-second of an inch to about ¼ inch. The pores should have a diameter of not greater than about 10 microns and not less than about 5 microns and the porosity should be substantially uniform through the area of the porous wall preferably within the range from about 40 to about 50%. The active area of the filtering surface should be within the range from about 25 square inches to about 55 square inches. A unit of these characteristics will produce bubbles of the inert gas in the liquid having an initial size within the range of from about 5 to about 25 microns.

Preferably, the subdividing unit is a vertically arranged porous cylinder of the type described, closed at its top end. In this arrangement the gas is introduced in a lateral direction and the bubbles describe a graceful lateral and upward curved path. This gives almost twice as much contact time as would be the case if the element were installed in a horizontal position with the dispensing openings facing in the upward direction. In this preferred arrangement the initial velocity of the bubbles being in the lateral direction causes them to slow down, rather than accelerate, as they would if projected in the upward direction, where initial velocity would be added to buoyancy.

BRIEF DESCRIPTION OF THE DRAWINGS

The invention has been generally defined and it will now be described in greater detail by reference to the accompanying drawings, illustrating preferred embodiments, and in which:

FIG. 1 is a schematic diagram showing a dispensing saturator-generator connected to a receiving unit, in this case a core box and connecting piping;

FIG. 2 illustrates an electrical timer cabinet used in conjunction with the apparatus shown in FIG. 1;

DESCRIPTION OF THE PREFERRED EMBODIMENTS

Figure 3:
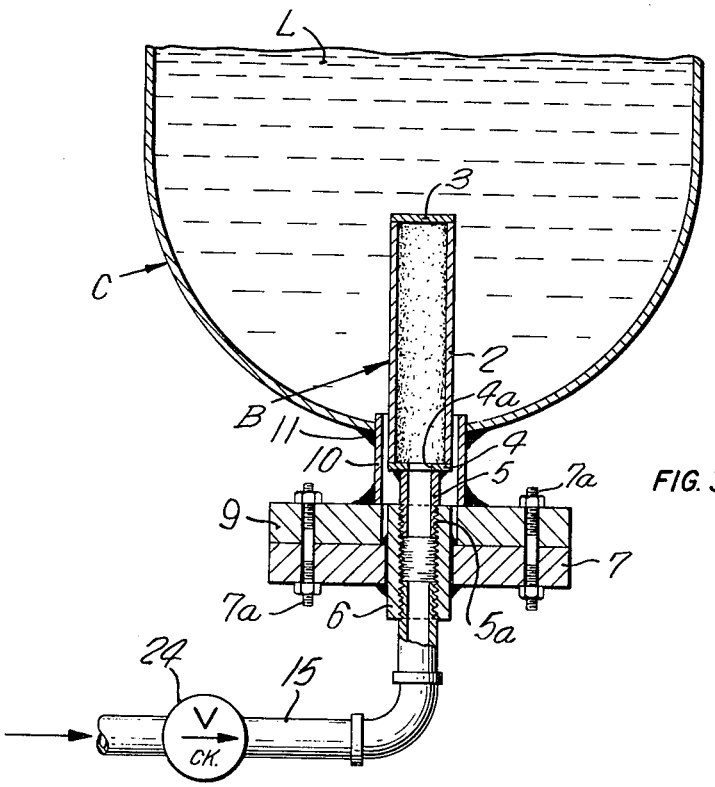
FIG. 3 is an enlarged fragmentary cross-section partly in elevation showing the dispensing saturator-generator and its connection to the holding vessel.

Referring more particularly to the drawings, the apparatus has the following features. A source of inert gas, for example, a bulk carbon dioxide tank A has a supply line 15 running from it, optionally through a heater 17, a pressure regulator 19 set for desired pressure (which to some extent will depend on the size of the core being formed), a safety relief valve 21, for example set at 50 psig, a bass-type shut-off valve 22 (manual), a spring loaded check valve 24, to a subdividing unit B, located at the bottom of an elongated vertically disposed pressure vessel C. 16 is a liquid amine supply line provided with a ball-type shut-off valve 26. The vessel C is provided with a glass level liquid gauge 27, a pressure gauge 34, and a safety relief valve 33.

The subdividing unit B includes a porous cylinder 2 of sintered cylindrical stainless steel having welded to it a non-porous metal cap 3 and a metal base piece 4. The base piece 4 is welded to a short tubular member 5 whose bore connects with a central opening 4*a* in the base member 4. The end of the pipe 5 is externally threaded as at 5*a* and threadably engages a tubular connecting member 6 welded to a base plate 7. The base plate 7 is, in turn, connected, by bolts 7*a*, to a base plate 9, welded to the tubular member 10 which enters an opening in the bottom of the vessel C and is welded to it as at 11. The member 6 is internally threaded to engage, at its upper end, the member 5 and, at its lower end, the terminal end of the pipe 15. By this arrangement, the subdividing unit B may be readily attached to or detached from the vessel C.

From the vessel C runs a gassing line 29 which passes through an electrically operated pneumatically assisted ball-type valve 31 and a spring loaded check valve 36 to a core box D. 30 and 32 are air lines to operate the automatic valving. The line 30 leads to the gassing line 29 from a source of air under pressure.

E is an electrical timer cabinet provided with an amine vapor timer 42 and an air purge timer 40. An acid scrubber F and an afterburner G are shown connected to the exit of the core box D. Either may be selected for afterburning or scrubbing the excess amine exiting from the core.

The operation of the apparatus is as follows.

To prepare for start-up of the unit, the vessel C is partially filled to provide a body of a liquid amine L by connecting a transfer line to the line 16, opening the valve 26 and pumping amine into the vessel C through the check valve 16. The valve 26 is then closed. The amine level will show on the liquid level gauge 27.

The carbon dioxide supply tank A is connected to the vessel C and gas allowed to flow through the heater 17, where necessary to provide the desired gas temperature. The gas from the heater 17, or directly from the tank A, enters the pressure control regulator 19 which reduces the pressure to the desired level. This level depends on the size of the sand core to be gassed. The gas flows through the valve 22, through the check valve 24, and through the unit B immersed in liquid amine in the tank C.

The inert gas is broken up, by the dispensing saturator-generator B, into micron size bubbles to effect intimate contact with the liquid amine and bubbles through the amine and leaves the surface of the liquid to enter the space V above the body of liquid amine, and continues flowing until the pressure in the vapor space of the vessel is at the level set on the regulator 19.

When gassing of the core is desired, the timing program is preset for the core size involved and the timer panel actuated by pressing a starter button 43. The starter button closes the circuit for the T-1 gas timer 42 which opens the pneumatic valve 31 and allows curing vapor to pass from the vessel C to the core D for the time interval preset on the T-1 gas timer 42. When the preset time has elapsed, the gas timer 42 opens the circuit to the gassing valve 31, which then closes pneumatically and simultaneously actuates the air purge timer 40, which opens the air purge valve 37 and air is flushed through the sand core. At the end of the air purge time sequence, the air purge T-2 timer 40 closes the air purge valve 37. The exit amine-air from the vents of the core box is manifolded and passed either through the acid scrubber F which neutralizes the toxic amine or, optionally, through the afterburner G which burns the amine to completion.

When the T-1 gas timer 42 actuates the opening of the gas valve 31 and allows gas to flow to the core, the resultant pressure drop is felt by the control regulator 19 which immediately acts to restore equilibrium pressure by allowing more $CO_2$ to flow through the unit B, creating more amine-saturated vapor until the preset pressure is reached and pressure equilibrium is restored and the reservoir of amine/$CO_2$ vapor is ready for the next cycle.

This pressure restoration is completed after the gassing cycle valve 31 closes and the air purge through the core is proceeding.

From this description, it will be seen that the vessel C, the subdividing unit B, and associated apparatus is in effect a generator-saturator-dispenser and the piping leading from the vapor space V to the cavity of the core box D a receiving unit for the vapor.

Figure 4:
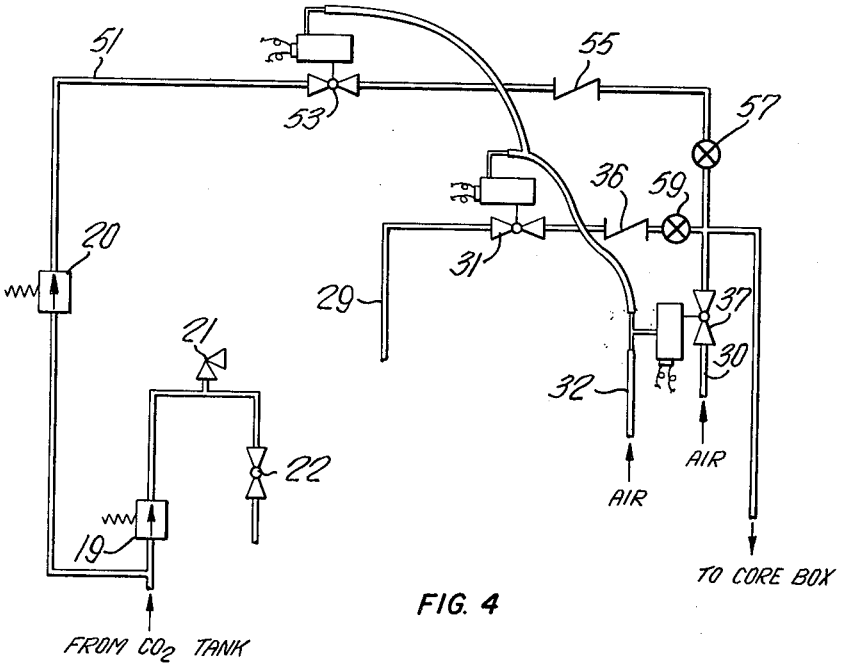
FIG. 4 is a schematic diagram showing a modification, to the gas circuit, of the apparatus illustrated in the previous Figures.

FIG. 4 illustrates a modification of the apparatus shown in FIG. 1. This modification is preferably employed when using amines having a vapor pressure not less than 100 millimeters at 68° F., for example D.M.E.A. (dimethylamine) (vapor pressure 550 millimeters at 68° F.) or other amine having a significantly higher vapor pressure than T.E.A. (trimethylamine) (53 millimeters at 68° F.).

Insofar as FIG. 4 duplicates FIG. 1, the same reference numerals have been retained. The modified structure is as follows. A $CO_2$ bypass line 51 is teed off immediately upstream of the control regulator 19 and equipped with a similar control regulator 20. The line 51 leads to an electrically operated valve 53, a check valve 55 and a throttling valve 57 and thence back to the line 29 at its junction with the line 38 leading from the valve 37. A throttling valve 59 is installed downstream of the check valve 36 on the line 29. The valve 53 is connected electrically to the T-1 gas timer 42 so that it opens and closes simultaneously with the valve 31. By varying the throttling action of the valves 57 and 59, it is possible to control the portion of the amine and the $CO_2$ going to the core and thus to attain maximum economy of amine.

The arrangement of FIG. 4 allows the operator to vary the amine concentration in the gas stream going to the core to suit maximum economy conditions, when using D.M.E.A. or other amines having a vapor pressure not less than 100 millimeters at 68° F. as the curing medium. As the vapor pressure of D.M.E.A. is much higher than T.E.A., the amine concentration in the vapor space of the gas unit will be higher than necessary for good cores. By allowing the operator to select the concentration of amine best suited for his individual needs, and by restricting the amount of amine-$CO_2$ vapor coming from the gassing unit and adding pure $CO_2$ to this stream on the way to the core box, maximum economy is effected. Purging is also facilitated, since no more amine than necessary need be deposited in the core.

The diluting gas used with the modified arrangement of FIG. 4 has been described as $CO_2$. Other inert gas could be used as the diluting gas. For example, air could be used, although this is less desirable since it introduces the possibility of a flammable mixture being formed.

As the invention has a preferred applicaton in curing the binder in foundry cores, it has been illustrated in this context. This art is described typically and binder resins and curing agents disclosed in U.S. Pat. Nos. 3,409,579 Robbins (1968), 3,428,110 Walker et al (1969), 3,590,902 Walker et al (1971), 3,632,844 Robbins (1972), and other patents, the disclosures of which are hereby incorporated by reference. The procedure may be briefly summarized as mixing a foundry aggregate, usually sand, with a binding amount of a polymerizable or curable binder and a substance with which it reacts, and introducing the mix into a core box, mold or pattern to form a "green" core or mold and then passing a catalyst in gaseous form into the core box, mold or pattern to bring about curing of the binder. The more modern procedures employ, as curable binders, epoxy resins, polyester resins, petroleum polymers, alkyd resins, and phenol-formaldehyde resins together with a polyisocyanate. The catalytic gas employed is an amine, for example, triethylamine or dimethylamine.

The present invention, although specially useful with the curing materials mentioned, does not depend on their nature, but is a means of physically supplying a dependable supply catalyst or curing substance in saturated vapor form and dispensing it throughout the core so as to reach all parts of it in a minimum time and with the use of a minimum amount of catalyst material. The net result is considerable economy both in time and materials.

While this is true of the specific application to the preparation of foundry cores, it is equally true of the application of the invention to the provision of any saturated vapor of an active liquid substance and an inert carrier gas, where it is important that the active liquid in vapor phase be thoroughly dispersed throughout the gas, with no free liquid entrainment, and where it is important that a supply of the saturated vapor under substantially constant pressure be available at all times and be replenished, with substantially minimum loss of pressure immediately an increment is withdrawn from the supply.

VARIABLE FACTORS

Gasses

In theory, any gas can be used as the saturated generated gas provided that it is compatible with the liquid active agents with which it is to be intermixed. Any non-oxidative gas which is inert under the conditions of use may be employed as the carrier gas, for example carbon dioxide and nitrogen or argon. Practically speaking, carbon dioxide and nitrogen are preferred. Carbon dioxide has the advantage, over nitrogen, that it is one and one-half times as heavy as air and will maintain a blanketing effect to provide a non-flammable mixture of amine-$CO_2$ longer than an amine-nitrogen mixture. Nitrogen is slightly lighter than air and will diffuse to the surrounding atmosphere faster than $CO_2$. The gasses described are not inert in an absolute sense, but are inert under the ambient conditions of the invention.

The Aggregate

The usual aggregates for making sand molds may be employed. Often this may simply be foundry sand which is available in nature, for example on the shores of Lake Michigan. It may have inert additives. The nature of the aggregate is not critical to the invention, as applied to curing cores, except that it should not be undesirable reactive with the curing agents.

Absence of Moisture

Another important factor is that mositure must be kept out of the system. Desirably, the system is first dried out, for example by passing say nitrogen, carbon dioxide, or air, through the line 15 and through the entire system either at ambient or higher temperatures (to speed up the procedure) before starting to use the system. The carrier gas used to carry out the process should be dry. For example, in the case of carbon dioxide, it should be dried at least to a dew point of $-60°$ F. The applicant has found that where there is moisture in the incoming carbon dioxide, this causes carbonates to form and cake on the subdividing unit. In the case of nitrogen, this does not take place. But, with nitrogen, it is desirable that the system be moisture-free for another reason. In the case of core gassing, where the binders are hygroscopic, the presence of moisture may result in "sugary" cores.

OPERATING CONDITIONS AND EQUIPMENT

The Subdividing Unit

A preferred subdividing device is a sintered cylindrical stainless steel element, as described as follows in Bulletin E25B of Pall Trinity Micro corporation. The stainless steel is said to be made by sintering flat sheets of prealloyed powder under U.S. Pat. No. 2,554,343. No binders are used, which increase carbon content, and sintering is done without pressure. The resulting sheet is four to five times more permeable and contact strength two to three times greater than where pressure is used. The sheet medium is uniformly porous material with up to 50% of its volume made of interconnecting voids or pores.

Such a device is available as a simple cylinder, heliarc welded at one end to a solid stainless steel end cap and at the other end to a stainless steel pipe nipple externally threaded at its outer end. The cartridge will stand a differential pressure of 50 psi in either the normal or the reverse direction of flow. Other characteristics are described elsewhere in this disclosure.

Temperature-Pressure-Time

Temperature is important in the formation of the amine vapor. As $CO_2$ is bubbled through the liquid amine, some of the liquid amine will vaporize. This vaporization will cause a temperature drop and result in a lower concentration of amine vapor in the gaseous $CO_2$. Should this drop be allowed to continue the gassing times will get longer. It is desirable to keep the liquid amine at a little below the surrounding ambient temperature and, if necessary, a heater may be employed to adjust the amine temperature.

A main problem, specially when dealing with an amine having a low vapor pressure, for example T.E.A., is the difficulty of maintaining a sufficient amount of the amine in the carbon dioxide vapor.

The ambient temperature surrounding the vessel and the temperature of the incoming gas, and consequently the temperature of the amine liquid are critical. If the temperature of the amine liquid drops below about 55° F. the concentration in the vapor would drop to the point where unduly extended core gassing times would be necessary to deposit the required amount of amine. Moreover, with the increased amount of carbon dioxide, which must be passed through the system to supply the necessary amount of amine, further cooling would take place and this again would tend to lower the amine temperature.

As soon as the $CO_2$ is flowed into the saturator-generator, some amine will vaporize and cause a slight drop in temperature. The faster the cycling the lower the temperature of the liquid amime will drop. Should the temperture of the amine be allowed to fall excessively, for example, through fast cycling, the amine percentage will fall to the point that coring will be slowed and typical high speed coring impossible. Under normal conditions the ambient air surrounding the vessel will be sufficient to add enough heat to maintain the liquid amine approximately 5° F. below the surrounding atmospheric temperature. Should this not be sufficient, heating of the incoming $CO_2$ would have to be resorted to, to maintain a temperature balance.

Preheating if done at all must be done with caution. If the temperature of the liquid amine were to be raised due to increasing the temperature of the $CO_2$ unduly, there is the danger of condensation taking place in the exit pipes between the generator and the core box or within the sand in the core box proper. In sum, a fine heat balance is essential to prevent outgassing.

The temperature of the generator and the core box or other receiving vessel (at rest) would normally be the same, as they are generally in close vicinity and subject to the same surrounding temperature. In any case, the temperature of the $CO_2$ amine vapor must not be raised higher than that of the receiving unit. In the case of cold box gassing the temperature must be maintained at less than the sand temperature in the core box, and is preferably maintained at slightly below this temperature, for example at least 2° or 3° F. below the temperature of the sand in the core box. This prevents condensation of the amine on contact with the sand.

While these problems have been discussed in connection with gassing cores, where they are particularly critical, the same may apply when the dispensing saturator-generator is used with other receiving units in which it is critical to provide a completely saturated vapor and to exclude entrained liquid droplets. In brief, then, the temperature of the liquid must be maintained sufficiently high to maintain a vapor pressure at which there will be a substantially maximum amount of the active liquid in its gaseous phase in the vapor, but, at the same time, the temperature must be sufficiently low to avoid possible condensation in the receiving unit.

The aggregate is usually blown into the core box cavity at a pressure of from about 60 to about 90 lbs. per square inch. The curing vapor is introduced at a pressure within the range from about 4 to about 40 lbs. per square inch. The pressure must be such that, on opening the gassing cycle, it have enough potential to completely displace the trapped air within the sand and to intimately contact the binder on each grain. Generally speaking, the range of pressure will preferably be from about 10 to about 15 psi for cores having a thickness of up to 8 inches and pressures up to 30 psi for thicker cores. The purge gas is blown in to complete the cure and to drive out any residue of unreacted curing vapor at a pressure preferably from about 50 to about 100 lbs. per square inch.

A fast curing cycle is desirable. However, the actual time of this cycle will depend on the size of the core. Typical times for cores of different sizes are as follows:

| Core Weight | Gassing Time | Purging Time |
|---|---|---|
| 2 oz. to 15 lbs. | .25 to 1 sec. | .5 to 3.5 sec. |
| 50 lbs. to 120 lbs. | 2 to 3 sec. | 3 to 5 sec. |

Maintaining Equilibrium

It will be seen that the conditions imposed on the generator by the dispensing cycle are as follows. The vapor is dispensed from the vessel in intermittent bursts, intervened by short periods of vapor recuperation. This takes place continuously over a given period of time. The relatively constant movement of the gas and vapor through the system will disturb its equilibrium, and interfere with good results, if the changes are not compensated for as provided for herein.

For example, an excessive pressure drop, as each dose is dispensed, would cause a lowering of the temperature and an acceleration of the gas through the liquid invariably causing liquid particles to be carried into the vapor space and, thence, into the receiving system.

To be sure of maintaining a saturated temperature at optimum concentration of liquid in the vapor, it is important that the pressure drop on each dispensing dose be maintained below a given maximum.

Using core gassing, as an example, with heavy cores, say 7 to 8 inches thick and which weigh, for instance, 50 pounds and up, and, where the gassing pressure would be within the range from about 20 to about 40 pounds per square inch, the pressure drop should not exceed about 10%. In the case of thinner cores, say 3 to 4 inches thick, where the gassing pressure might run within the range from 10 to 15 pounds per square inch, a pressure drop up to about 25% may be tolerated.

The process of the invention is adapted for the wide range of variable duty encountered in practice. Taking cold box core gassing, for example, the applicant's process may be used for short jobbing runs involving only say 10 to 20 cores, up to long runs in a high production foundry. In the latter, the same core box may be used every working day, up to 24 hours a day, with cores being produced every 30 seconds. There must be total continuity to maintain the equilibrium of the system under such heavy duty so as to make sure that the solution dispensed is always saturated.

The saturator-generator may also be connected in parallel to several receiving units. Considering core gassing, for example, as shown in FIG. 1, the line 29, from the vessel C, could be connected in a T to a line from which a number of separate piping units could be led to respective valves similar to the valve 31 and thence to the rest of a dispensing system for each core box. Where there are several receiving units, it is specially important that the volume of the vapor space V be equal to satisfying the maximum demand at any given point in time. If the dispensing arrangement is such that all the receiving units can call for vapor at the same time, the vapor space V should be large enough to satisfy them all at the same time. Then the space V should have a volume of at least 3 and preferably at least 4 times the combined volume of the spaces in the receiving unit. Alternatively, if the timing of the valving to the respective receiving units is sequenced so that only one of the receiving units can call for vapor at any one dispensing dose, then the vapor space V may be correspondingly smaller.

I claim:

1. A process for generating in a pressure vessel a ready supply of a saturated vapor of a normally liquid active substance in an inert carrier gas under pressure and dispensing vapor intermittently from the supply, comprising, providing in the vessel a body of said active liquid substance and an overlying atmosphere of vapor in a space above said liquid, dispensing the vapor from the vapor space in a continuous series of intermittent bursts each producing a pressure drop within the vessel intervened by a short non-dispensing period, responsive immediately to the pressure drop caused by each burst introducing carrier gas under pressure into a bottom zone of the vessel during each non-dispensing period until equilibrium pressure is restored therein and the vapor lost in said burst is replaced by the introduction of additional gas, finely dividing said carrier gas as it is introduced to form in said liquid a mass of minute bubbles effective to provide intimate contact between gas and liquid whereby a saturated vapor is formed to the exclusion of entrained liquid and conveyed to the vapor space during each non-dispensing period, maintaining a relationship between the depth of the vapor space, the head of liquid above the introduction zone, the relative volume of each burst to that of the vapor space, and the initial size of the bubbles so as to ensure the presence in the vapor space of a true saturated vapor substantially free of entrained liquid.

2. A process, as defined in claim 1, in which the height of the saturated vapor space in the vessel is maintained at at least the height of the liquid space.

3. A process, as defined in claim 1, in which the volume of each dose is maintained at not more than one-third of the volume of the saturated vapor space.

4. A process, as defined in claim 1, in which the height of the saturated vapor space in the vessel is maintained at at least the height of the liquid space, and the volume of each dose is maintained at not more than one-third of the volume of the saturated vapor space.

5. A process, as defined in claim 4, in which the bubbles have an initial diameter not exceeding about 25 microns.

6. A process, as defined in claim 4, in which the head of liquid above said bottom zone is at least about 8 inches.

7. A process, as defined in claim 4, in which the height of the vessel is at least five times its mean width.

8. A process, as defined in claim 1, in which the bubbles have an initial diameter not exceeding about 25 microns.

9. A process, as defined in claim 1, in which the saturated vapor is dispensed to a receiving unit at a temperature not greater than that of the receiving unit.

10. A process as defined in claim 1 wherein each burst of dispensed saturated vapor is for a period on the order of from 0.25 to 3 seconds.

11. A process as defined in claim 1 wherein each burst of dispensed saturated vapor is for a period on the order of from 0.25 to 1 second.

12. A process as defined in claim 1 wherein each burst of dispensed saturated vapor is for a period on the order of from 2 to 3 seconds.

13. A process as defined in claim 1 wherein the liquid is maintained at a minimum temperature on the order of 55° F.

14. A process, as defined in claim 1, wherein the liquid is maintained at a temperature within the range of 55° to 73° F.

15. A process for generating in a pressure vessel a ready supply of a saturated vapor of a normally liquid active substance in an inert carrier gas under pressure and dispensing vapor intermittently from the supply, comprising, providing and maintaining under a predetermined controlled pressure a body of said active liquid substance and an overlying atmosphere of saturated vapor in a space above said liquid at at least the height of liquid, dispensing under said pressure, over a period of time, a continuous series of intermittent doses each of a volume not greater than one-third the volume of said vapor space, simultaneously with the dispensing of each dose, bubbling carrier gas under said controlled pressure into a bottom zone of said liquid in minute bubbles having an initial size not greater than about 25 microns in diameter whereby intimate intercontact is made between the gas and the liquid and a saturated vapor is formed and conveyed to the vapor space in an amount to replace the dose dispensed, maintaining a head of liquid above said bubbling zone of at least about 8 inches whereby the intercontact time between the gas bubbles and liquid is such as to ensure the presence in the vapor space of a true saturated vapor to the exclusion of liquid.

16. A process, as defined in claim 4, in which said controlled pressure is within the range from about 4 to about 40 pounds per square inch.

17. A process for generating in a pressure vessel a ready supply of a saturated vapor of a normally liquid active substance in an inert carrier gas under pressure and dispensing vapor intermittently from the supply, comprising, providing in the vessel a body of said active liquid substance and an overlying atmosphere of saturated vapor in a space above said liquid, dispensing the saturated vapor intermittently in a series of predetermined doses, simultaneously with the dispensing of each dose, bubbling carrier gas under pressure into a bottom zone through a sintered metal partition having pores opening into the liquid not exceeding a mean diameter of about 10 microns whereby the gas is introduced into the liquid in the form of minute bubbles, maintaining a relationship between the depth of the vapor space, the head of liquid above the bubbling zone, the relative volume of each dose to that of the vapor space, and the initial size of the bubbles so as to ensure the presence in the vapor space of a true saturated vapor to the exclusion of liquid.

18. A process, as defined in claim 17, in which the partition is a flat wall.

19. A process, as defined in claim 17, in which the partition is a cylinder.

20. A process, as defined in claim 19, in which the cylinder has an active surface area within the range from about 25 square inches to about 55 square inches and a substantially uniform porosity within the range from about 40% to about 50%.

21. A process, as defined in claim 17, in which the partition is an elongated cylinder substantially vertically disposed.

22. A process, as defined in claim 21, in which the cylinder has a length from about 5 to about 10 inches, an outside diameter from about 1 inch to about $2\frac{1}{2}$ inches, and a wall thickness within the range from about 1/32 of an inch to about $\frac{1}{4}$ inch.

* * * * *